United States Patent [19]

Staley et al.

[11] Patent Number: 4,880,568

[45] Date of Patent: Nov. 14, 1989

[54] METHOD AND COMPOSITION FOR THE REMOVAL OF AMMONIUM SALT AND METAL COMPOUND DEPOSITS

[75] Inventors: Charles M. Staley, Houston; Verle E. Cornish, Missouri City, both of Tex.

[73] Assignee: Aqua Process, Inc., Houston, Tex.

[21] Appl. No.: 231,519

[22] Filed: Aug. 11, 1988

Related U.S. Application Data

[62] Division of Ser. No. 87,497, Aug. 19, 1987, Pat. No. 4,793,865.

[51] Int. Cl.[4] ..... C11D 3/26

[52] U.S. Cl. ..... 252/548; 252/170; 252/544

[58] Field of Search ..... 252/548, 544, 170

[56] References Cited

U.S. PATENT DOCUMENTS

| | | | |
|---|---|---|---|
| 3,481,877 | 12/1969 | Moll | 252/79.5 |
| 3,671,447 | 6/1972 | Kowalski | 252/180 |
| 3,740,352 | 6/1973 | Sommers | 252/548 |
| 3,754,990 | 8/1973 | Teumac et al. | 134/2 |
| 4,003,856 | 1/1977 | Sharp | 252/546 |
| 4,032,360 | 6/1977 | Sharp | 134/3 |
| 4,793,865 | 12/1988 | Staley et al. | 134/2 |

FOREIGN PATENT DOCUMENTS

| | | | |
|---|---|---|---|
| 5009732 | 2/1967 | Japan | 134/2 |

*Primary Examiner*—Asok Pal

*Attorney, Agent, or Firm*—A. Triantaphyllis

[57] ABSTRACT

Amines are injected in hydrocarbon processing units to remove and/or to prevent the formation of ammonium salt deposits. Furthermore, oxygen containing hydrocarbon compounds are injected in hydrocarbon processing units to remove metal compound deposits. The amines and/or the oxygen containing compounds may be injected alone or in combination. Furthermore, the amines and/or the oxygen containing compounds may be used in combination with filming agents that are suitable for corrosion control in such units.

7 Claims, No Drawings

METHOD AND COMPOSITION FOR THE REMOVAL OF AMMONIUM SALT AND METAL COMPOUND DEPOSITS

This is a divisional of co-pending application Ser. No. 087,497, filed on Aug. 19, 1987, now U.S. Pat. No. 4,793,865.

TECHNICAL FIELD

The present invention relates to the field of deposit and corrosion control in hydrocarbon processing units and more particularly, to the field of removal and/or prevention of formation of ammonium salt and metal compound deposits in refinery and petrochemical processing units. Still more particularly, the present invention relates to a method and composition for the removal and/or prevention of formation of ammonium salt and metal compound deposits in refinery and petrochemical processing units by contacting the ammonium salt deposits with amines and, the metal compound deposits with oxygenated hydrocarbon compounds.

BACKGROUND OF THE INVENTION

A frequent source of operating problems in refining and petrochemical processing units is the formation of deposits throughout those units resulting in an increase in pressure drop, decrease in efficiency, increase in energy consumption, loss of operating time, and other well-known difficulties. These deposits include salts of ammonia, inorganic contaminants that enter the process in the feed, and deposits that develop as by-products from corrosion of the processing unit including metal sulfides, metal oxides, metal hydroxides, and other metal salts. These deposits alone or in combination with other hydrocarbon polymers and decomposition products often form deposits that are difficult to remove from the internals of the processing units.

Another source of operating problems in refining and petrochemical processing units is corrosion which is the result of the exposure of the metal surfaces to corrosive compounds that are frequently found in the stream being processed by the particular unit. Corrosion leads not only to the formation of unwanted deposits but also to metal and equipment failure.

Presently, film forming agents or filmers alone or in combination with dispersants are used to prevent the formation of deposits and/or the corrosion of the equipment of the various hydrocarbon processing units. Those film forming agents and/or dispersants, however, often do not function satisfactorily as fouling prevention agents and/or aggravate the conditions of the hydrocarbon processing unit.

One problem encountered is that the film forming agents or the dispersants, used alone or in combination, are unable to remove certain deposits that have a tendency to firmly affix onto the surface of the equipment. Those deposits usually consist of hydrocarbon polymers or decomposition products that are aggregated or glued together by salts and various metal compound by-products.

Another problem encountered is that the filmers used to prevent the fouling or the corrosion formation are not effective when the metal surface of the unit is covered by various types of deposits referred to above. Their ineffectiveness is due to the fact that the filmers are unable to form a tenacious complete film on the surface. Furthermore, the presence of deposits prevents the filmers from reaching the surface under the deposits, thereby allowing the corrosion under those deposits to proceed without control. Still another problem measureably encountered is that the filmers and/or the dispersants often cause the formation of an emulsion thereby resulting in process operating difficulties.

Another disadvantage of the filmers and/or the dispersants and the methods for using the same is that, under certain conditions, those filming agents and/or dispersants cause further deposit formations and promote fouling. That was usually attributed to thermal decomposition and unexpected chemical reaction of the filmer and/or the dispersant.

A further disadvantage of the filmers and dispersants presently used is that, due to the fact that large amounts of those filmers and dispersants are required to prevent fouling and corrosion in the unit, the product manufactured by the processing unit in question is sometimes contaminated with those filmers and dispersants.

All the aforementioned problems and disadvantages are overcome by the present invention by disclosing a method and composition for the complete removal and/or prevention of formation of deposits of ammonium salts and metal compounds by interacting those deposits with certain amines and oxygenated hydrocarbon compounds. As a result, the metal surfaces of the processing units remain clean thereby enabling the filming agents to form a tenacious and complete film on those surfaces and to effectively prevent the corrosion of those surfaces. The compositions disclosed by the present invention eliminate the use of dispersants and the formation of undesirable emulsions resulting therefrom. Furthermore, the compositions disclosed herein do not result in the formation of unexpected deposits or in the contamination of the products manufactured by the particular processing unit.

These and other advantages of the present invention will become apparent from the following description:

SUMMARY OF THE INVENTION

Amines are injected to a hydrocarbon processing unit to remove and/or control the formation of ammonium salt deposits in the unit. The amines are oxygen containing amines and react with the ammonium salt to form ammonia and an amine salt that has a low melting point and/or a high affinity for water. The amine salt, which is insoluble in hydrocarbons, exits the unit in a liquid state with the processed liquids.

An oxygenated hydrocarbon compound such as a ketone, alcohol, an ether, or a combination thereof is injected in a hydrocarbon processing unit to remove or to prevent the formation of metal compound deposits in the unit. The oxygenated hydrocarbon compounds act as chelating agents to form stable chelates with the metals of the metal compound deposits. Those chelates then exit the unit in question with the processed liquids.

In most processing units both ammonium salt and metal compound deposits are present. In those instances, both amines and oxygen containing hydrocarbon chelating agents are used together to effect the removal of both types of deposits. The amounts and ratios of deposit removal agents depends on the amount of ammonium salt and metal compound deposits in the system. Amines may be used alone in the system when only ammonium salt deposits are present whereas, oxygen containing hydrocarbon chelating agents may be used alone when only metal compound deposits are present in the system.

The aforementioned treating agents may be injected into the unit intermittently or continuously. A continuous injection is, however, preferred, to ensure the maintenance of clean surfaces in the processing unit. Furthermore, the aforementioned treating agents may be used in combination with filming agents that are used for the prevention and/or control of corrosion in the system.

DETAILED DESCRIPTION OF THE INVENTION

According to the present invention, certain chemical agents are used to remove and/or to prevent the accumulation of inorganic deposits that are commonly found in refinery and petrochemical processing units. These deposits include ammonium salts, other inorganic contaminants that enter the process in the feed and deposits that develop as byproducts from corrosion in the processing units. These corrosion products include metal sulfides, metal oxides, metal hydroxides, and other metal salts. The salts and/or metal compounds often combine with hydrocarbon polymers and decomposition products to form deposits that are difficult to remove. Consequently, the pressure drop in those units is increased, their efficiency is decreased, the number of failures is increased, and other well-known operating problems occur.

The invention is primarily directed to the removal and/or prevention of formation of two general types of deposits, namely, ammonium salt deposits and metal compound deposits. Certain amines are used to remove and/or to prevent the formation of the ammonium salt deposits and certain oxygenated hydrocarbon compounds such as alcohols, ketones, ethers or a combination thereof are used to remove and/or to prevent the formation of metal compound deposits.

Although several ammonium salt compounds are formed in refinery or petrochemical processing units, the most common ammonium salts are those formed with halides. Still the most common ammonium salt halide deposits are ammonium chloride deposits.

According to the present invention, the ammonium salt deposits are contacted with an amine to form ammonia and amine salts. It is necessary that the amine salts be in liquid form, whereby they can be continuously removed with the liquid exiting the processing unit. Solid amine salts are not desirable because they tend to precipitate and to remain in the unit, whereby, they result in further operational problems. Accordingly, certain amines are employed that form amine salts having a low melting point or an extreme affinity for trace amounts of water. The latter requirement takes advantage of the fact that small amounts of water are found in essentially all processing units. Amine salts having an affinity for water will form a liquid compound with such water. Amines that form amine salts having low melting point or extreme affinity for trace amount of waters are those that contain oxygen. Examples of such amines are dimethylethanolamine, monomethylethanolamine, methoxypropylamine, monoethanolamine, monoethylethanolamine, diethylethanolamine, propanolamines, and other similar oxygen containing amines. The melting point of the amine salt formed from those amines is in the range of 120° F. to 190° F.

As mentioned hereinabove, another of deposit that is often encountered in refining and petrochemical processing units are deposits of metal compounds, the most common being those of iron. According to the present invention, complexing agents are employed to react with those metal compound deposits and to form chemical complexes that flow out of the processing unit with the liquid effluents thereof. Those complexing agents are various oxygenated hydrocarbon compounds such as alcohols, ketones, ethers or combinations thereof. Because oxygenated compounds having only one oxygen atom are not very effective complexing agents, it is preferred that alcohols, ketones, ethers or combinations thereof having at least two oxygen atoms be utilized as complexing agents. Such compounds include polyones, polyols, polyethers, and combinations of ether, ketone and alcohol groups in one molecule. Those compounds that have at least two oxygen molecules react with the metal compounds to form a chelate wherein the metal compound forms a multiple complex bonding with the polyoxygenated hydrocarbon agent to effectively remove such metal compound from the unit. These oxygenated hydrocarbon compounds that form chelates with the metal compounds to effect the removal of the metal deposits from the units are otherwise known as chelating agents. Examples of effective chelating agents include diones such as acetylacetone and 3-alkyl acetylacetones; hydroxy ketones such as diacetone alcohol and related derivatives; diols, such as 2,4-dihydroxypentane, 2, 4-dyhydroxy-2 methylpentane and 2,4-dihydroxy-2,4-dimethylpentane; and ethers such as 4-methoxy-4-methyl-2-pentanone and 2, 4-dimethoxypentane.

When a chelating agent contacts the metal deposit, the metal forms an electron bond with the oxygen atoms present in the chelating agent. Because chelating agents may include more than two oxygen atoms and because the relative position of each oxygen atom with respect to other oxygen atoms may vary depending on the chelating agent being used, it is conceivable that the metal ion may form several metal chelate rings having different configurations. It is preferred however, that the chelate rings be stable to accomplish the most efficient removal of the metal compound deposits. Chelates having six member or five member chelate rings are generally the most stable chelates. Therefore, chelating agents forming such rings are preferred. For purposes of clarification, a six member chelate ring is the one wherein the metal ion forms a first electron bond with a first oxygen and a second electron bond with a second oxygen, the first oxygen forms a bond with a first carbon, the first carbon forms a carbon bond with a second carbon, the second carbon forms a carbon bond with a third carbon, and the third carbon forms a bond with the second oxygen whereby a six member chelate ring is formed. Similarly, a five member chelate ring is formed wherein a metal ion forms a first electron bond with the first oxygen and a second electron bond with the second oxygen, the first oxygen forms a bond with a first carbon, the first carbon forms a carbon bond with a second carbon, and the second carbon forms a bond with the second oxygen whereby a five member ring is formed.

A five member chelate ring is formed by chelating agents in which the first oxygen atom is attached to a carbon atom that forms a carbon bond with a second carbon atom and the second carbon atom forms a bond with the second oxygen atom. An example of such chelating agent is 2,3-butanedione (diacetyl). A chelating agent that forms a six member chelate ring is an oxygenated hydrocarbon compound in which the first oxygen atom forms an electron bond with the first carbon atom, the first carbon atom forms a carbon bond with a second carbon atom, the second carbon atom forms a carbon bond with a third carbon atom, and the third carbon atom forms a bond with the second oxygen atom of the chelating agent. An example of a chelating agent forming a six ring chelate is 2,4-pentanedione (acetylacetone).

The choice of chelating agent depends on the nature of the metal deposit, the availability of the agent, the economics, and most importantly the strength of the chelating agent, i.e., the ability of such agent to remove metal ions from the affected surface. Some chelating agents are very strong and they are unsuitable in some applications because they may, not only remove the metal deposit but also the metal of the underlying surface of the unit. This may cause the rapid erosion of the metal and the subsequent formation of cavities or structure failures. An example of a very strong chelating agent is acetylacetone. On the alternative, the use of a weak chelating agent may be ineffective because the agent may not be able to remove the deposited metals. Accordingly, it is important that one chooses the chelating agent with the appropriate strength for the particular system.

The strength of the chelating agent depends on the molecular structure of the oxygen portion of the agent, i.e., whether it is carbonyl, hydroxyl, alkoxy, aryloxy, and the extent of hydrogen substitution adjacent to such oxygen portion with other hydrogen groups. For example, chelating agents having two carbonyl groups are very strong agents, whereas, agents wherein one or both of those carbonyl groups are substituted with a hydroxy, alkoxy or aryloxy group are weaker. An example of a very strong chelating agent is acetylacetone, whereas, examples of weaker agents are diacetone alcohol, hexylene glycol, 4-methoxy-4-methyl-2-pentanone, and 4-phenoxy-4-methyl-2-pentanone.

According to the present invention, the amines for the removal of ammonium salt deposits and the chelating agents can be used alone or in combination depending on whether both types of deposits are present. More particularly, in the case where both ammonium salts and metal compounds are found in the deposits, a combination of amines and chelating agent may be applied to remove those deposits. Although the ratio of amine to chelating agent may vary depending on the particular application, the ratio of amine to chelating agent is usually in the range from 0.1 to 10 with most applications utilizing a ratio ranging from 0.33 to 3. In applications in which ammonium salts are not present, the chelating agent may be used alone. Similarly, in applications in which metal deposits are not present, the ammonium salt removal agent, i.e., the amine may be used alone.

The amines and the chelating agents may be used to remove existing deposits in hydrocarbon processing units. They may also be used to prevent the formation or accumulation of such deposits in deposit free units and to maintain clean surfaces in those units In the former case, it is preferred that a larger dosage or amount be injected into the unit to accomplish a fast and complete removal of the deposits. Although the amount may range widely, depending on the amount of deposits present, it is preferred that the amount of the combined amines and chelating agents used to remove existing deposits range from 10 to 50 ppm of treating agent per amount of feed in the particular unit. In the latter case, when one desires to prevent the formation of new deposits and to maintain a clean surface, the amines and/or the chelating agents may be injected continuously into the system through appropriate locations such as the feed line of the particular unit. The amount of treating agents may range widely, depending on the process parameters. It is, however, preferred that the amount of treating agents, i.e., amines and/or chelating agents, range from 1 to 15ppm per amount of feed.

One significant aspect of the invention is that the maintenance of clean surfaces by supplying the method and composition disclosed enables various filming agents, such as imidazoline or similar carboxylic acid compounds, and other corrosion inhibitors to operate efficiently. More particularly, a filming agent is less effective as an antifoulant or corrosion inhibitor when a metal surface is covered with deposits because the filming agent molecules are unable to form a tenacious, complete film on dirty surfaces or to protect the surface under the deposits. The agents disclosed by the present invention maintain the cleanliness of the surfaces whereby the filming agents are allowed to form strong continuous films on the surfaces and to prevent corrosion. Accordingly, the amines and the chelating agents disclosed by the present invention may be used together with filming agents to maintain a clean, corrosion-free environment in the particular unit.

The following examples further illustrate the invention but are not to be construed as limitations on the scope of the process contemplated herein.

EXAMPLE 1

A severe fouling problem occurred in a debutanizer tower following the platformer in a refinery. Furthermore, a severe overhead corrosion occurred in the same tower. In order to solve the fouling problem, a water wash system was installed and was employed every one or two months resulting in lost production. All attempts to inhibit the corrosion in the overhead were not successful.

An analysis of the deposits causing the fouling in the tower showed that the fouling was principally due ammonium chloride and iron chloride. The ammonium chloride was formed by the reaction of hydrogen chloride with ammonia. Hydrogen chloride was formed by the reaction of ethylene dichloride with the reformer catalyst to maintain its activity. The ammonia was the byproduct of a chemical reaction that the reformer feed underwent as it passed through the catalyst bed. The small amount of moisture in the processing system was sufficient to react with the iron metallurgy, in the chloride-rich environment, to produce iron chloride. When the moisture was separated out during the process sequence and the water content of the stream in the debutanizer becomes very small, the ammonium chloride and iron chloride salts formed deposits in the unit.

On Aug. 29, 1986, the injection of a mixture containing corrosion inhibitor/neutralizer and diacetone alcohol and 4-methoxy-4-methyl-2-pentanone as chelating agents was commenced into the overhead line of the debutanizer. On Sept. 8, 1986, an injection of a mixture containing dimethylethanolamine, a corrosion inhibitor and the aforementioned chelating agents was commenced into the reflux line of the tower. Prior to the commencement of that injection, the pressure drop in the tower had increased, resulting in loss of distillation efficiency. Shortly after the injection of the amine/chelating agent/corrosion inhibitor mixture was started, the pressure build up in the tower was eliminated and the tower function stabilized. Shortly thereafter, the injection of a mixture containing the amine, the chelating agents and the corrosion inhibitor, with an amine concentration higher than the concentration previously used in the injection to the reflux line that started on Sept. 8, 1986, was commenced into the feed to the tower in order to contact the ammonium chloride before it was deposited therein. The ratio of amine to chelating agents in that injection was approximately 4 to 1. At the same time, the composition of the overhead filming agent being injected into the overhead was modified to provide additional corrosion inhibitor protection and to maintain chelating components in the tower to continue with the removal of iron chloride deposits. Furthermore, the injection to the reflux line was discontinued. The aggregate amount of amine and chelating agents ranged from 3 to 15 ppm per amount of feed to the tower.

The injection of the aforementioned chemicals worked exceptionally well and at the accelerated dosages restored the unit to "start of run" operating conditions. No further washing was required for over nine months. When after the passage of nine months, the injection of the aforementioned agents was discontinued, deposits were formed in the tower and another water wash was required. Immediately thereafter, the chemical injection of the aforementioned agents was restored, and the tower operation continued at normal operational levels.

EXAMPLE 2

A depropanizer fractionating tower that was part of a continuous catalytic reformer system had experienced severe fouling and corrosion problems shortly after it was started up. Periodic water washes to correct the problem were found to be inefficient and an elaborate continuous water wash system was installed. The continuous water wash system also failed to solve the deposit problem. The processing system had to be shut down periodically for complete overhaul and cleanout. The cost of such maintenance procedures, loss in production, and replacement of corroded components was very high. The effluent of the depropanizer in those operations contained less than 1 ppm of chloride.

In order to solve the deposit and corrosion problem, mixture of amines and chelating agents was injected into the tower for approximately one to two weeks at a rate ranging from 5 to 15 ppm of mixture per amount of feed. Following the injection of that mixture, the effluent chloride concentration rose rapidly from less than 1 ppm to greater than 20 ppm indicating the removal of chloride containing deposits. Furthermore, the pressure in the tower stabilized to some extent, but the time of treatment was not long enough to bring the tower back to top efficiency. At the end of this short trial, and as soon as the chemical was stopped, the chloride level leaving the tower dropped back to less than 1 ppm indicating that no removal of chloride-containing deposits occurred.

Although the invention is described with respect to specific embodiments and modifications, the details hereof are not to be construed as limitations except to the extent indicated in the following claims.

What is claimed is:

1. A composition for treating a refinery or a hydrocarbon processing unit to effect the removal of ammonium salt and metal compound deposits, comprising:

an oxygen-containing amine suitable for reacting with the ammonium salt deposit to form an amine salt; and an oxygenated hydrocarbon compound suitable for reacting with the metal compound deposits to form a chelate, the oxygenated hydrocarbon compound having at least two oxygens, one of which is part of a keto group in the hydrocarbon compound.

2. A composition according to claim 1 further including a filming agent.

3. A composition according to claim 2 wherein the filming agent is a corrosion inhibitor.

4. A composition according to claim 2 wherein the filming agent is imidazoline.

5. A composition according to claim 1 wherein the oxygenated hydrocarbon compound is 4-methoxy-4-methyl-2-pentanone.

6. A composition according to claim 1 wherein the amine is dimethylethanolamine.

7. A composition according to claim 1 wherein the ratio of the amine to the oxygenated-hydrocarbon compound is in the range from 0.1 to 10.

* * * * *

UNITED STATES PATENT AND TRADEMARK OFFICE

CERTIFICATE OF CORRECTION

PATENT NO. : 4,880,568

DATED : NOVEMBER 14, 1989

INVENTOR(S) : CHARLES M. STALEY, VERLE E. CORNISH, HOWARD J. PLATTE

It is certified that error appears in the above—identified patent and that said Letters Patent is hereby corrected as shown below:

On the cover page, column 1, item (75) Inventors:

after "City", delete ", both" and insert

--; Howard J. Platte, Houston, all --.

Signed and Sealed this

Eighth Day of January, 1991

*Attest:*

*Attesting Officer*

HARRY F. MANBECK, JR.

*Commissioner of Patents and Trademarks*